United States Patent [19]

Riordan

[11] Patent Number: 4,843,375

[45] Date of Patent: Jun. 27, 1989

[54] ROLL-UP ALARM SCREEN ASSEMBLY AND SHIPPING CONTAINER THEREFOR

[76] Inventor: Dennis E. Riordan, Los Angeles, Calif.

[21] Appl. No.: 10,345

[22] Filed: Feb. 3, 1987

[51] Int. Cl.[4] ..... G08B 13/08

[52] U.S. Cl. ..... 340/550

[58] Field of Search ..... 340/550; 160/10; 206/315.11; 229/126

[56] References Cited

U.S. PATENT DOCUMENTS

| | | | |
|---|---|---|---|
| 2,962,187 | 11/1960 | Morris | 206/315.11 X |
| 3,051,935 | 8/1962 | Wilson | 340/550 |
| 3,167,236 | 1/1965 | Scheinman | 229/126 |
| 3,240,418 | 3/1966 | Elias | 229/126 |
| 3,696,373 | 10/1972 | Dunn et al. | 340/550 |
| 4,146,293 | 3/1979 | Mutton et al. | 340/545 X |
| 4,160,972 | 7/1979 | La Mell et al. | 340/550 X |
| 4,232,310 | 11/1980 | Wilson | 340/550 |
| 4,281,320 | 7/1981 | Rosenberg | 340/545 |
| 4,293,778 | 10/1981 | Williams | 340/550 X |
| 4,514,725 | 4/1985 | Bristley | 340/691 |

*Primary Examiner*—Glen R. Swann, III

*Assistant Examiner*—Tat K. Wong

*Attorney, Agent, or Firm*—W. Edward Johansen

[57] ABSTRACT

The present invention is a roll-up alarm screen assembly for use in a frame. The frame has a first magnet disposed in its bottom portion and a second magnet disposed in its top portion. The roll-up alarm screen assembly includes an alarm screen and a roll-up mechanism which rolls the alarm screen up and down. The alarm screen includes a screen mesh and a conductive wire which is mechanically coupled to the screen mesh. The roll-up alarm screen assembly also includes a first magnetic coupler and a second magnetic coupler. The first magnetic coupler electrically couples severed ends of conductive wire when the first magnetic coupler is disposed adjacent to the first magnet. The second magnetic coupler electrically couples severed ends of conductive wire when the second magnetic coupler is mechanically coupled to the roll-up mechanism and is positioned so that the second magnetic coupler is disposed adjacent to the second magnet in order to detect any movement of either the roll-up mechanism or the screen mesh.

7 Claims, 4 Drawing Sheets

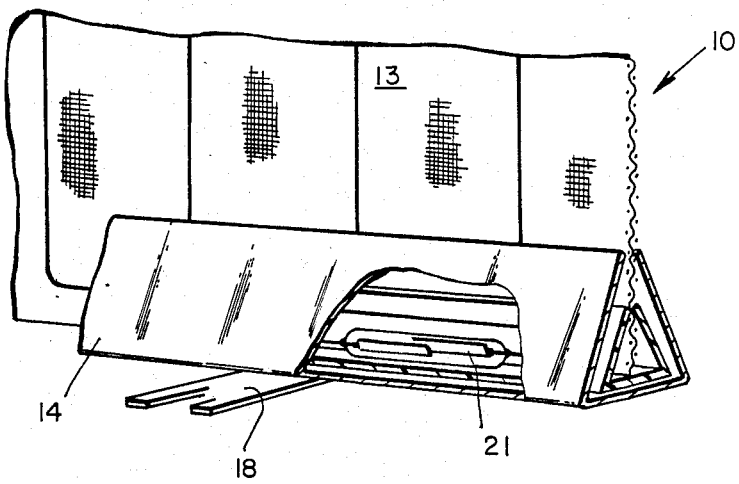
Fig. 4.
Fig. 6.
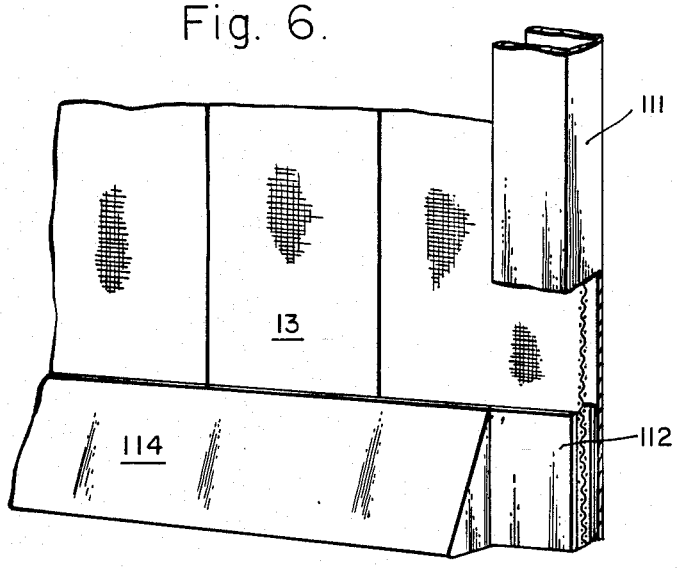
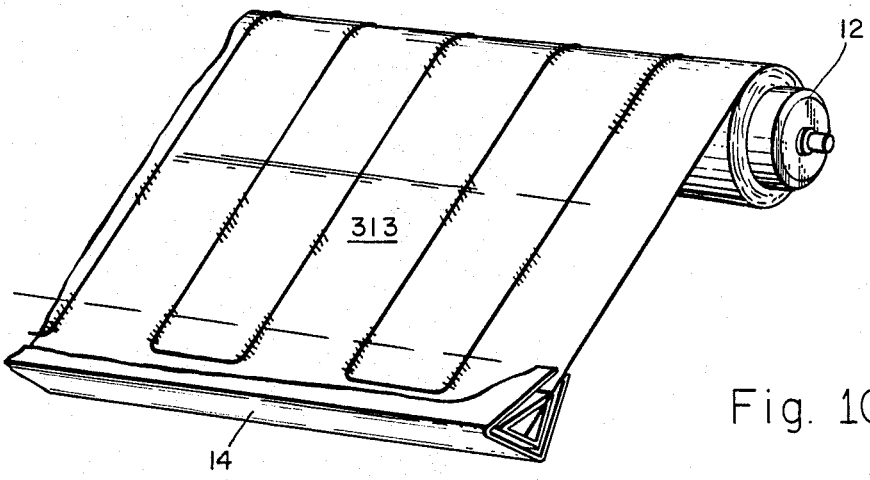
Fig. 10.

ROLL-UP ALARM SCREEN ASSEMBLY AND SHIPPING CONTAINER THEREFOR

BACKGROUND OF THE INVENTION

1. Field of the Invention

The present invention relates to a roll-up alarm screen for use in an alarm system and more particularly to a roll-up alarm screen which can be easily and conveniently shipped in a container across country.

2. Description of the Prior Art

U.S. Pat. No. 3,051,935, entitled Protective Screen, issued to Clarence P. Willson on Aug. 28, 1962, teaches an alarm screen which includes a frame which is mounted on a building enclosing structure, a screen mesh which is formed from a sheet of non-conductive screen material and which has its marginal portion secured to the frame and at least two strands of conductive wire which are disposed parallel and spaced apart and which are interwoven in the screen mesh with each of the strands having an end portion which terminates adjacent to the frame. It is necessary to mechanically splice together, by either soldering or twisting to each other, the ends of the sounds of conductive wire in order to form a continuous wire.

U.S. Pat. No. 4,146,293, entitled Entry Detection Screen, issued to Robert E. Mutton and Dennis E. Riordan on Mar. 27, 1979, teaches an alarm screen which includes a frame and a screen mesh. In one embodiment the alarm screen also includes a single wire which is sewn onto the screen mesh in order to fix it in place and which provide a series circuit. In another embodiment the alarm screen also includes double wires which are sewn onto the screen mesh in order to fix it in place so that two series circuits can be provided. The double wires can be twisted to make the alarm circuit more difficult for an intruder to defeat. A twist of the double wires can be made under a section of frame where the twist cannot be seen by an intruder. In both embodiments the single wire and the double wires are continuous. Unlike the alarm screen U.S. Pat. No. 3,051,935 mechanical splicing of strands of conductive wire is not necessary.

U.S. Pat. No. 4,380,290, entitled Shipping and Storage Container, issued to Randall A. Luebke on Apr. 19, 1983, teaches a container for shipping and storing elongated articles. The container includes a tubular housing having oppositely disposed open ends and a pair of end cap members which are adapted to be removably mounted to the tubular housing.

U.S. Pat. No. 4,232,310, entitled Protective Window Screen Assembly, issued to Clarence P. Wilson on Nov. 4, 1980, teaches a screen assembly which includes a rectangular screen mesh with several parallel security strands of insulated conductive wire extending between opposite sides of the screen mesh. Insulated cross wires lie on a face of the screen mesh near the opposite sides thereof, are joined by welding or soldering to points on the security strands, and are cut at selected locations to provide a sinuous electrical path through the screen mesh. A spline of insulative material extends around the border of the screen mesh and encapsulated the locations where the cross wire is joined to the security strands.

U.S. Pat. No. 4,399,855, entitled Roll Type Closure Assembly for a Window, issued to Boris Volfson on Aug. 23, 1983 teaches side edge guides for a roller shade which is mounted by brackets in the window casing.

Each side edge guide includes a channel portion, a mounting flange portion and a connecting portion. The mounting flange receives the side edge of the window shade. The connecting portion is disposed between the mounting flange portion and the channel portion. A U-shaped roller housing encloses the roller and is mounted by end caps on the roller mounting brackets to provide a seal between the upper portion of the window shade and the top of the window casing.

U.S. Pat. No. 4,281,320, entitled Combined Protective Barrier and Burglar Alarm, issued to Ariel Rosenberg on July 28, 1981, teaches a protective barrier and burglar alarm in the form of a window blind which includes a plurality of slats which may be compacted to open the blind. The slats are supported by flexible cords including electrical conductors for establishing an electrically-conductive pathway throught the length of the window blind. The lower end of the blind carries a mechanism with a magnet for retaining the blind in is closed position. The magnet actuate a magnetic read switch is carried at the lower end of the blind and which is interrupted when the blind is raised or severed thereby actuating an alarm.

U.S. Pat. No. 4,160,972, entitled Alarm Apparatus for Movable Barrier Members, issued to Kenneth La Mell on July 10, 1979, teaches magnetic reed switch which is normally open and which is mounted on the bottom of a barrier such as either a venetian blind or a curtain. A magnet is mounted in a window sill to hold the magnetic reed switch normally closed when the barrier is in its normal position. When the magnetic reed switch moves away from the magnetic reed switch opens to trigger an alarm system.

U.S. Pat. No. 4,514,725, entitled Window Shade Mounted Alarm System, issued to Barbara E. Bristley on Apr. 30, 1985, teaches a home alarm system for mounting on a retractable window shade which includes a display for summoning outside help in an emergency situation.

U.S. Pat. No. 4,535,830, entitled Lateral-Traction Roller Shade, issued to Hans Appel and Hermann Heidenescher on Aug. 20, 1985, teaches a lateral sleeve in a lateral-traction roller shade which has a housing. The lateral sleeve is rotatably mounted in the housing.

SUMMARY OF THE INVENTION

In view of the foregoing factors and conditions characteristic of the prior art it is the primary object of the present invention to provide a roll-up alarm screen assembly for use in an alarm system and which can be easily and conveniently shipped in a container across country.

In accordance with an embodiment of the present invention a roll-up alarm screen assembly for use in a frame is described. The frame has a first magnet disposed in its bottom portion and a second magnet disposed in its top portion. The roll-up alarm screen assembly includes an alarm screen and a roll-up mechanism which rolls the alarm screen up and down. The alarm screen includes a screen mesh and a conductive wire which is mechanically coupled to the screen mesh. The roll-up alarm screen assembly also includes a first magnetic coupler and a second magnetic coupler. The first magnetic coupler electrically couples severed ends of conductive wire when the first magnetic coupler is disposed adjacent to the first magnet. The second magnetic coupler electrically couples severed ends of conductive wire when the second magnetic coupler is mechanically coupled to the roll-up mechanism and is positioned so that the second magnetic coupler is disposed adjacent to the second magnet in order to detect any movement of either the roll-up mechanism or the screen mesh.

The features of the present invention which are believed to be novel are set forth with particularly in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 4 is a perspective drawing in cross-section of the base of the roll-up alarm screen assembly of FIG. 1 with a second magnetic reed switch, which is disposed on the roll-up alarm screen assembly, being aligned with a second magnet which is disposed adjacent to the roll-up alarm screen assembly.

FIG. 6 is a perspective drawing in cross-section of the base of the second embodiment of a roll-up alarm screen assembly which has been constructed in accordance with the principles of the present invention.

FIG. 10 is a perspective drawing of base of the third embodiment of a roll-up alarm screen assembly which has been constructed in accordance with the principles of the present invention.

DESCRIPTION OF THE PREFERRED EMBODIMENT

Figure 1:
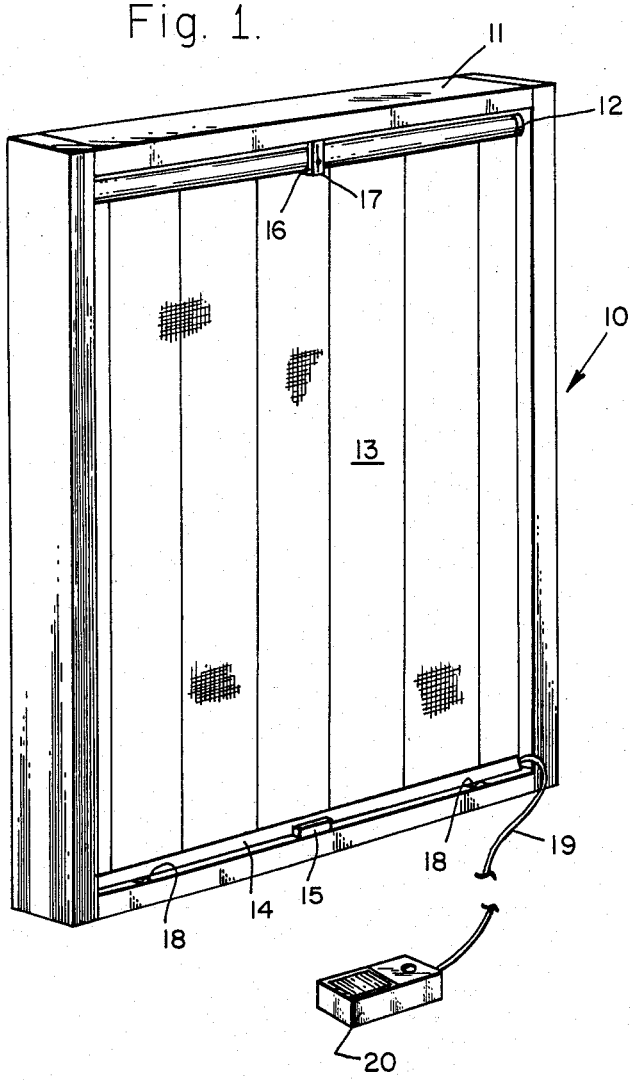
FIG. 1 is a perspective drawing of the first embodiment of a roll-up alarm screen system which includes an alarm device and a roll-up alarm screen assembly which has been constructed in accordance with the principles of the present invention.

In order to best understand the present invention it is necessary to refer to the following description of its preferred embodiment in conjunction with the accompanying drawing. Referring to FIG. 1 in conjunction with FIG. 2 a roll-up alarm screen assembly 10 for use in an alarm system which includes a frame 11. The roll-up screen assembly 10 includes a roll-up alarm mechanism 12 which is rotatably coupled to the frame 11, an alarm screen 13 which is mechanically coupled to the roll-up mechanism 12 at one end and a base 14 which is mechanically coupled to the alarm screen 13 at the other end. The alarm screen 13 includes a piece of screen mesh and a continuous strand of conductive wire which is mechanically coupled to the screen mesh. The roll-up mechanism 12 rolls the alarm screen 13 up and down. U.S. Pat. No. 4,535,830 teaches a roll-up mechanism.

Figure 2:
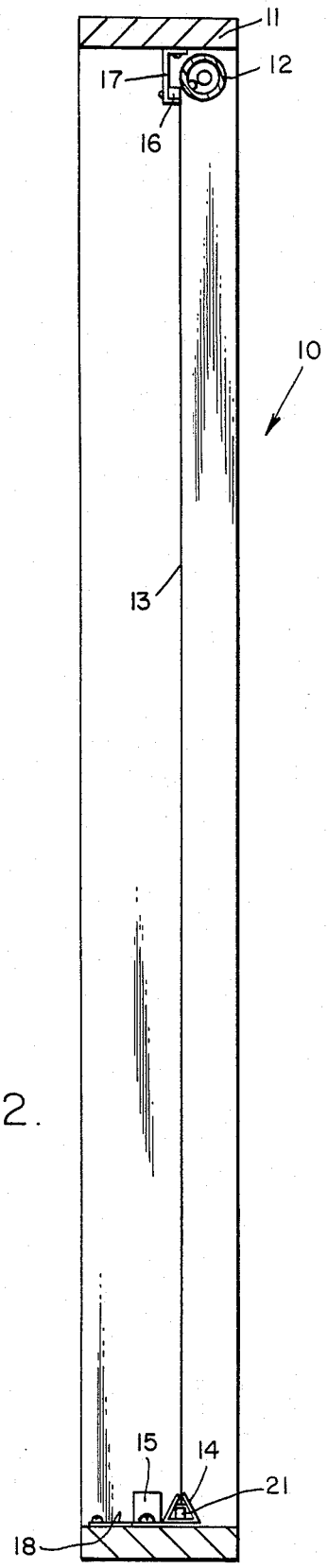
FIG. 2 is a side elevation of the first embodiment of the roll-up alarm screen system of FIG. 1.
Figure 3:
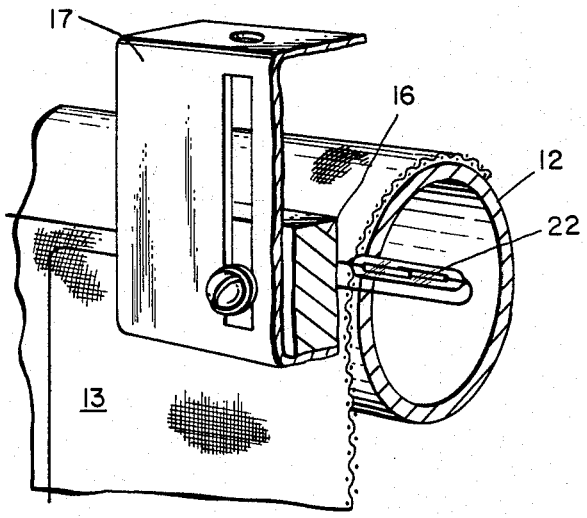
FIG. 3 is a perspective drawing in cross-section of the roll-up mechanism of the roll-up alarm screen assembly of FIG. 1 with a first magnetic reed switch, which is disposed on the roll-up alarm screen assembly, being aligned with a first magnet which is disposed adjacent to the roll-up alarm screen assembly.

Referring to FIG. 1 in conjunction with FIG. 2 the frame 11 has a first magnet 15 which is disposed in its bottom portion of the frame 11 and a second magnet 16 which is mechanically coupled to a magnet mount 17 which is mechanically coupled to the top portion of frame 11. The roll-up alarm screen assembly 10 also includes a latch 18 which is fixedly coupled to the base 14 and which is detachably coupled to the bottom portion of the frame 11. The alarm system further includes a cable 19 which is electrically coupled to the alarm screen mesh 13 and an alarm device 20 which is electrically coupled to the cable 19.

Figures 5, 11:
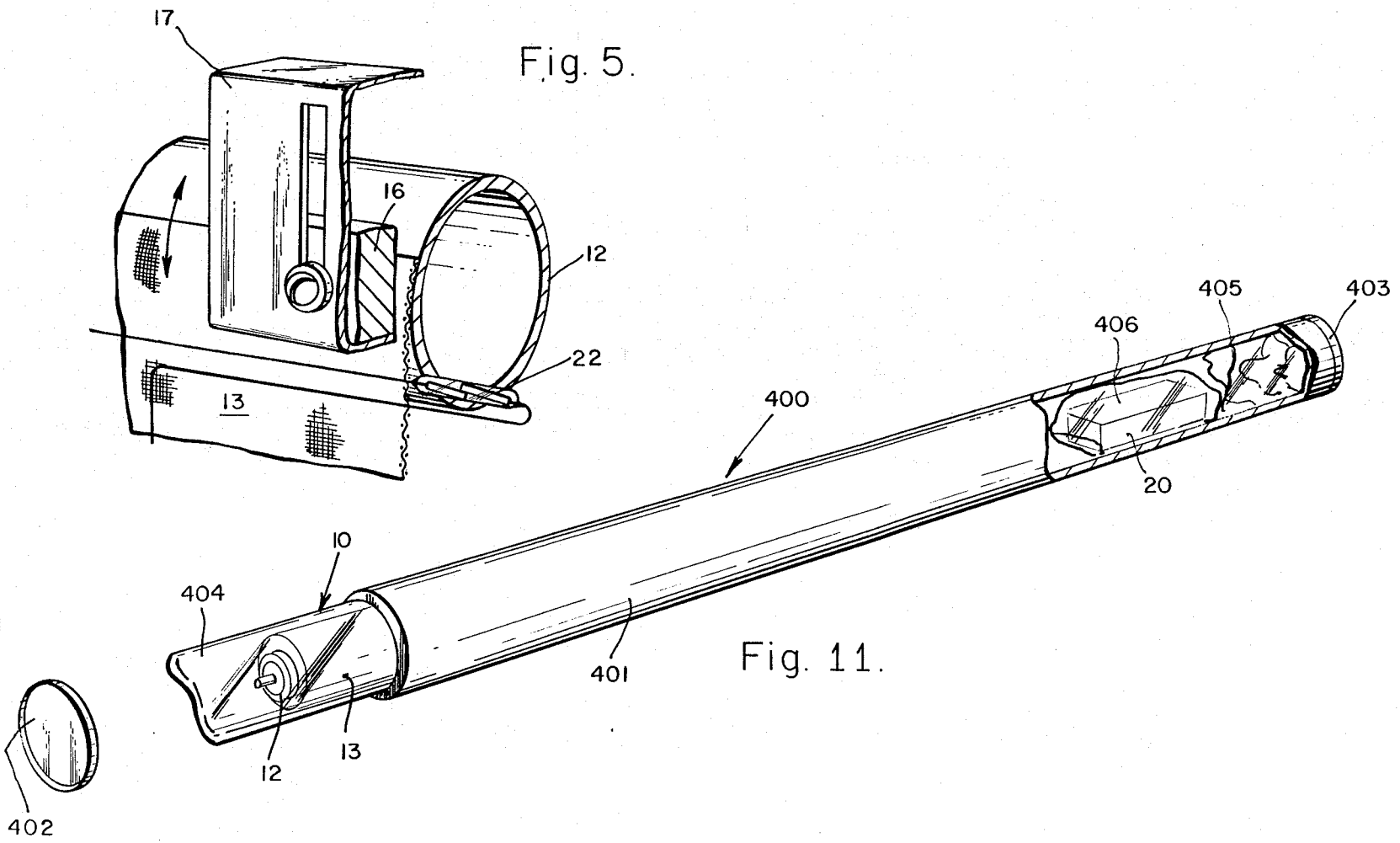
FIG. 5 is a perspective drawing in cross-section of the roll-up mechanism of the roll-up alarm screen assembly of Fig.1 with a first magnetic reed switch, which is disposed on the roll-up alarm screen assembly, having been moved so that it is no longer aligned with a first magnet which is disposed adjacent to the roll-up alarm screen assembly.
FIG. 11 is a perspective drawing of the tubular container of the roll-up alarm screen of FIG. 1 with a first plastic package being shown after it has been opened.

Referring to FIG. 1 in conjunction with FIG. 2, FIG. 3, FIG. 4 and FIG. 5 the roll-up alarm screen assembly 10 further includes a first magnetic coupler 12 and a second magnetic coupler 22. The first magnetic coupler 21 electrically couples severed ends of the continuous strand of wire when the first magnetic coupler 21 is disposed adjacent to the first magnet 15. Referring to FIG. 4 in conjunction with FIG. 2 if the base 14 is moved from its placement on the frame 11 then the first magnet is also moved away from the first magnetic coupler 21 thereby breaking the electrical circuit and triggering the alarm device 20. The second magnetic coupler 22 electrically couples severed ends of the conductive wire when the second magnetic coupler 22 is mechanically coupled to the roll-up mechanism 12 and is positioned so that the second magnetic coupler 22 is disposed adjacent to the second magnet 16 in order to detect any movement of either the roll-up mechanism 12 or the alarm screen 13. Referring to FIG. 5 in conjunction with FIG. 3 if the alarm screen 13 is pulled so that the roll-up mechanism 12 rotates about a one-quarter of an inch along its circumference the second magnet 16 is moved away from the second magnetic coupler 22 thereby breaking the electrical circuit and triggering the alarm device 20.

Referring to FIG. 6 a channel 111 is mechanically coupled to the side portion of the frame 11 and a connector-extension 112 is mechanically coupled to the base and the alarm screen 13 and the base 14. U.S. Pat. No. 4,399,855 teaches side edge guides for a roller shade which is mounted by brackets in the window casing.

Figure 7:
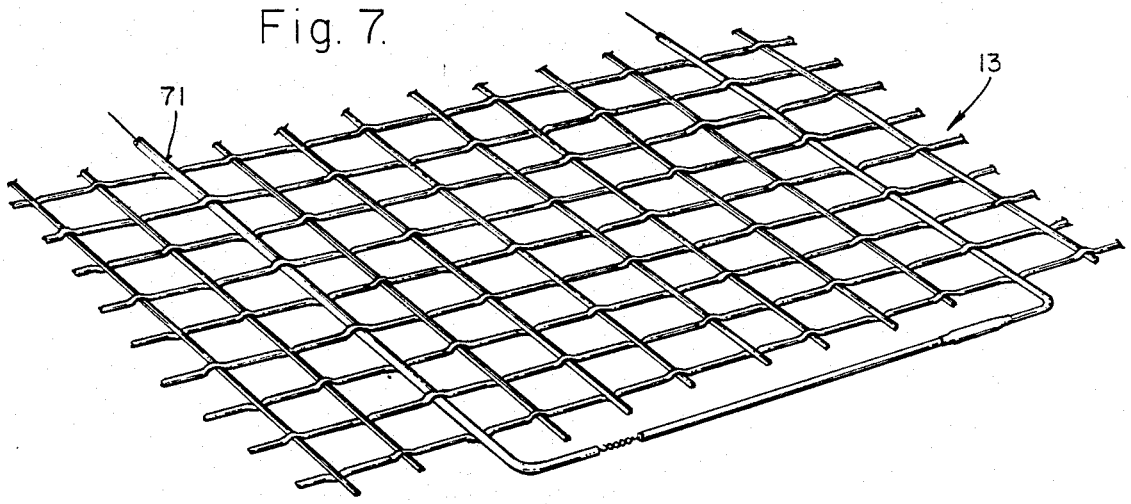
FIG. 7 is a perspective drawing of an alarm screen mesh with spliced strands of conductive wire which are interwoven into the screen mesh.

Referring to FIG. 7 a first alarm screen 13 includes a screen mesh and a plurality of strands of conductive wire 71 each of which is interwoven into the screen mesh and all of which are electrically coupled in series.

Figure 8:
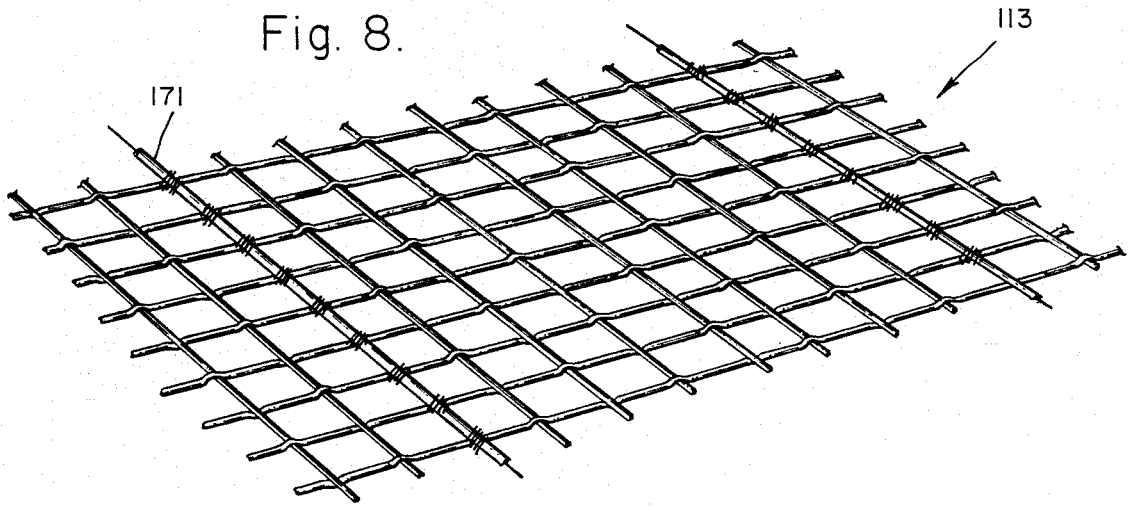
FIG. 8 is a perspective drawing of an alarm screen mesh with a continuous strand of conductive wire which is sewn onto the screen mesh.

Referring to FIG. 8 a second alarm screen 113 includes a screen mesh and a continuous strand of conductive wire 171 which is sewn onto the screen mesh.

Figure 9:
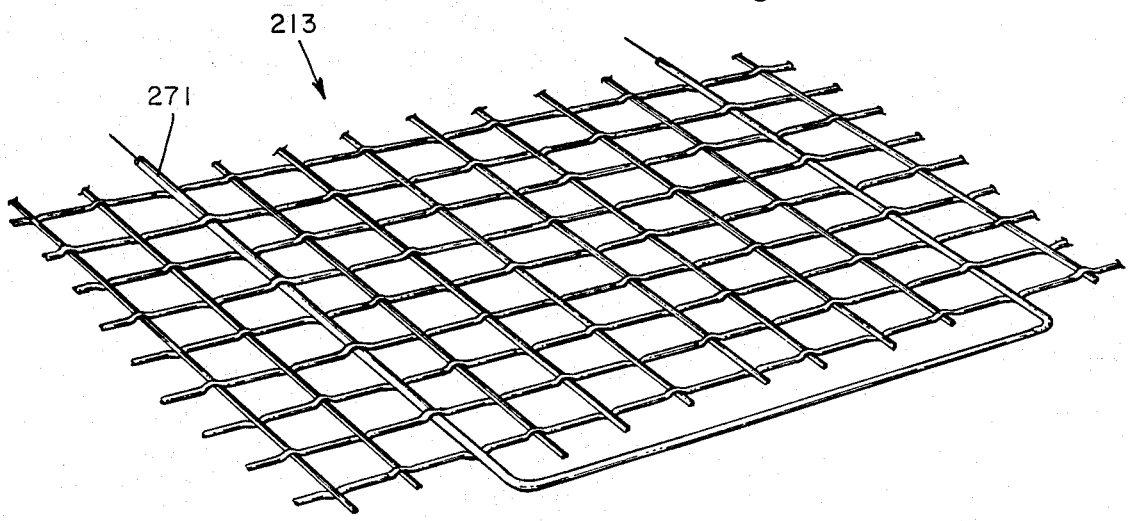
FIG. 9 is a perpective drawing of an alarm screen mesh with a continuous strand of conductive wire which is interwoven into the screen mesh.

Referring to FIG. 9 a third alarm screen 213 includes a screen mesh and a continuous strand of conductive wire 271 which is interwoven into the screen mesh.

Referring to FIG. 10 an alarm shade 313 includes a shade and a continuous strand of conductive wire which is sewn onto the piece of shade material.

Referring to FIG. 11 is a container 400 for the roll-up alarm screen assembly 10. The container 400 includes a tubular member 401 which has a first open end and a second open end and which is of a predetermined length and a predetermined diameter. The container 400 also includes a first end cap 402 and a second end cap 403 each of which is disposed at the first and second open ends of the tubular member 401, respectively. The container 400 further includes a first plastic package 404, a second plastic package 405 and a third plastic package 406. The roll-up mechanism 12 and the alarm screen mesh 13 of the roll-up alarm assembly 10 are placed in the first plastic package 404. The hardware for attaching the roll-up alarm assembly 10 to the frame 11 is placed in the second plastic package 405. The alarm device 20 may be placed in the third plastic package 406. The container 400 may be easily shipped across country by parcel post.

In yet another embodiment of the roll-up alarm screen assembly the continuous strand wire may be glued onto the screen mesh. In still yet other embodiments of the roll-up alarm shade assembly the cotinuous strand of wire may be either sewn or glued by an air hardening process onto the a piece of shade material.

In still yet another embodiment the container for the components for the alarm screen assembly may be a tubular member of rectangular cross-section. The ends of the rectangular tubular member are cut and folded over in order to enclose the components.

From the foregoing it can be seen that a roll-up alarm screen assembly has been described. It should be noted that the sketches are not drawn to scale and that distance of and between the figures are not to be considered significant.

Accordingly it is intended that the foregoing disclosure and showing made in the drawing shall be considered only as an illustration of the principles of the present invention.

What is claimed is:

1. A roll-up alarm screen assembly for use in a frame having a first magnet disposed in its bottom portion and a second magnet disclosed in its top portion, said roll-up alarm screen assembly comprising:

a. a screen mesh;

b. a conductive wire which is mechanically coupled to said screen mesh;

c. roll-up means for rolling up and down said screem mesh;

d. first magnetic coupling means for electrically coupling severed ends of said conductive wire when said first magnetic coupling means is disposed adjacent to said first magnet; and e. second magnetic coupling means for electrically coupling severed ends of said conductive wire whereby said second magnetic coupling means is mechanically coupled to said roll-up means and may be positioned so that said second magnetic coupling means is disposed adjacent to said second magnetic in order to detect any movement of either said roll-up means or said screen mesh.

2. A roll-up alarm screen assembly according to claim 1 wherein said conductive wire is a continuous strand and is interwoven into said screen mesh.

3. A roll-up alarm screen assembly according to claim 1 wherein said conductive wire is a continuous strand and is sewn onto said screen mesh.

4. A roll-up alarm shade assembly for use in a frame having a first magnet disposed in its bottom portion and a second magnet disposed in its top portion, said roll-up alarm shade assembly comprising:

a. a piece of shade material;

b. a conductive wire which is mechanically coupled to said piece of shade material;

c. roll-up means for rolling up and down said piece of shade material;

d. first magnetic coupling means for electrically coupling severed ends of said conductive wire when said first magnetic coupling means is disposed adjacent to said first magnet; and e. second magnetic coupling means for electrically coupling severed ends of said conductive wire whereby said second magnetic coupling means is mechanically coupled to said roll-up means and may be positioned so that said second magnetic coupling means is disposed adjacent to said second magnet in order to detect any movement of either said roll-up means or said piece of shade material.

5. A roll-up alarm screen assembly according to claim 1 wherein said conductive wire is a continuous strand and is glued onto said screen mesh.

6. A roll-up alarm shade assembly according to claim 4 wherein said conductive wire is a continuous strand and is sewn onto said a piece of shade material.

7. A roll-up alarm shade assembly according to claim 4 wherein said conductive wire is a continuous strand and is glued onto said a piece of shade material.

* * * * *